US006933453B1

(12) United States Patent
Lee

(10) Patent No.: US 6,933,453 B1
(45) Date of Patent: Aug. 23, 2005

(54) SWITCH CAPABLE OF SHOWING A CIRCLE OF LIGHT THEREON

(75) Inventor: Danny Lee, Kaohsiung (TW)

(73) Assignee: Shin Chin Industrial Co., Ltd., Tainan Hsien (TW)

( * ) Notice: Subject to any disclaimer, the term of this patent is extended or adjusted under 35 U.S.C. 154(b) by 0 days.

(21) Appl. No.: 10/968,112

(22) Filed: Oct. 20, 2004

(51) Int. Cl.[7] ..... H01H 9/00
(52) U.S. Cl. ..... 200/312; 200/313; 200/317
(58) Field of Search ..... 200/308–317, 200/339, 329, 553

(56) References Cited

U.S. PATENT DOCUMENTS 4,340,791 A * 7/1982 Sorenson ..... 200/302.3
5,280,145 A * 1/1994 Mosier et al. ..... 200/313
5,336,859 A * 8/1994 Wojtanek et al. ..... 200/315
5,752,595 A * 5/1998 Fein et al. ..... 200/315
5,833,048 A * 11/1998 Dilly ..... 200/446
5,850,062 A * 12/1998 Botz et al. ..... 200/315
6,005,308 A * 12/1999 Bryde et al. ..... 307/157
6,310,308 B1 * 10/2001 Watson et al. ..... 200/520

* cited by examiner

*Primary Examiner*—Richard Lee
(74) *Attorney, Agent, or Firm*—Rosenberg, Klein & Lee

(57) ABSTRACT

A switch includes a transparent housing, a control member, and several light emitting elements; the control member is held in and pivoted to the housing with a depressed portion being within an opening at one end of the housing; the housing has two side compartments on two sides of a middle compartment, and an annular protrusion around the opening on an outer side thereof; the light emitting elements are held in the side compartments of the housing with legs thereof projecting outwards through other end of the housing such that the switch is available with the light emitting elements therein, and such that a circle of light will show on the annular protrusion around the control member when the light emitting elements are powered.

1 Claim, 4 Drawing Sheets

SWITCH CAPABLE OF SHOWING A CIRCLE OF LIGHT THEREON

BACKGROUND OF THE INVENTION

1. Field of the Invention

The present invention relates to a switch, more particularly one, which includes a transparent housing, and a control member held in and pivoted to the housing with a pressed portion being within an opening of the housing, and which is equipped with light emitting elements in the housing so as to be capable of showing a circle of light on an annular protrusion of the housing around the opening.

2. Brief Description of the Prior Art

When it is dark and the lighting off, people can't rapidly find the switch for the lighting, and they are prone to trip or hit objects accidentally while groping for the switch. To handle this problem, a kind of switches are available that are equipped with lamps on the panels or the control elements thereof.

Referring to FIG. 4, a conventional switch and socket assembly includes a main part 5, a transparent panel 4, and an electricity activated lighting plate 6. The main part 5 has a switch 51, and several socket portions 52, which switch 51 is used for starting or stopping the flow of electricity through the socket portions 52. The transparent panel 4 has a hole 41, a slot 42, a light dependent resistor 43 fitted in the hole 41, and a control element 44 movably fitted in the slot 42, which control element 44 is used for switching the light dependent resistor 43 on/off. The electricity activated lighting plate 6 is positioned right behind the panel 4, and connected to a power source. Thus, when the light dependent resistor 43 is on, and it is dark, the lighting plate 6 will be activated, thus providing illumination and helping people find the switch 51.

The present applicant also has devised an improvement on a switch, which was disclosed in U.S. patent application Ser. No. 10/890,187 filed on 14 Jul. 2004, "STRUCTURE OF A SWITCH". The switch includes a main body, a control, and an indicating lamp assembly secured in the control. The lamp assembly includes a first lamp, and a second lamp respectively used for helping people find the switch in the dark, and for indicating that the switch has been switched on. The first and the second lamps have a common leg, and a respective second leg. The common leg is electrically connected with a terminal of the switch. The second leg of the first lamp touches another terminal of the switch while the second leg of the second lamp will touch yet another terminal of the switch as soon as the switch is switched on. Therefore, when the switch is in the "off" position, the first lamp will produce light, but the second one won't. And, the second lamp will begin to produce light as soon as the switch is moved to the "on" position.

SUMMARY OF THE INVENTION

It is a main object of the present invention to provide an improvement on a switch, which can emit light so as to be easy to find in the dark.

The switch of the present invention includes a transparent housing, a control member, and several light emitting elements. The control member is held in and pivoted to the housing with a depressed portion being within an opening at one end of the housing. The housing has two side compartments on two sides of a middle compartment, and an annular protrusion around the opening on an outer side thereof. The light emitting elements are held in the side compartments of the housing with legs thereof projecting outwards through other end of the housing; thus, the switch is available with the light emitting elements therein, and a circle of light will show on the annular protrusion around the control member when the light emitting elements are powered.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
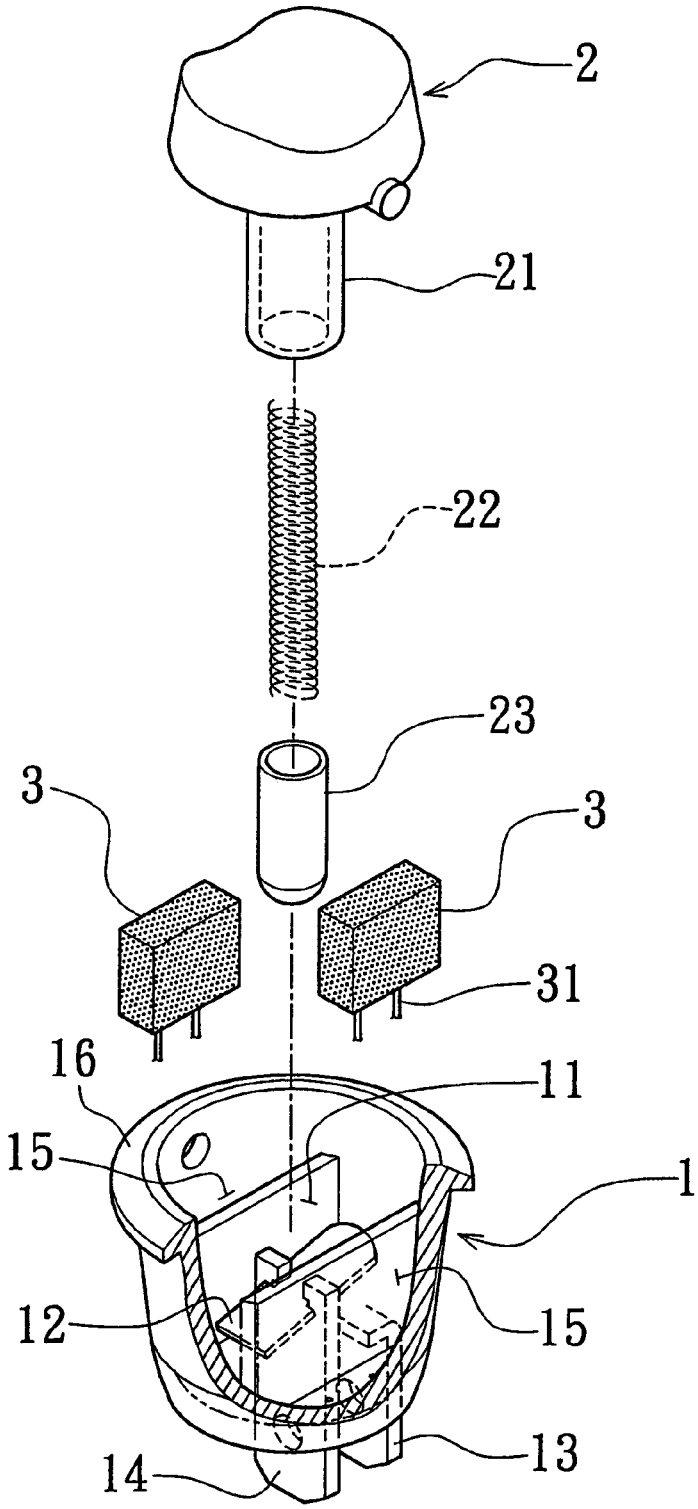
FIG. 1 is an exploded perspective view of the switch capable of showing a circle of light thereon according to the present invention.
Figure 2:
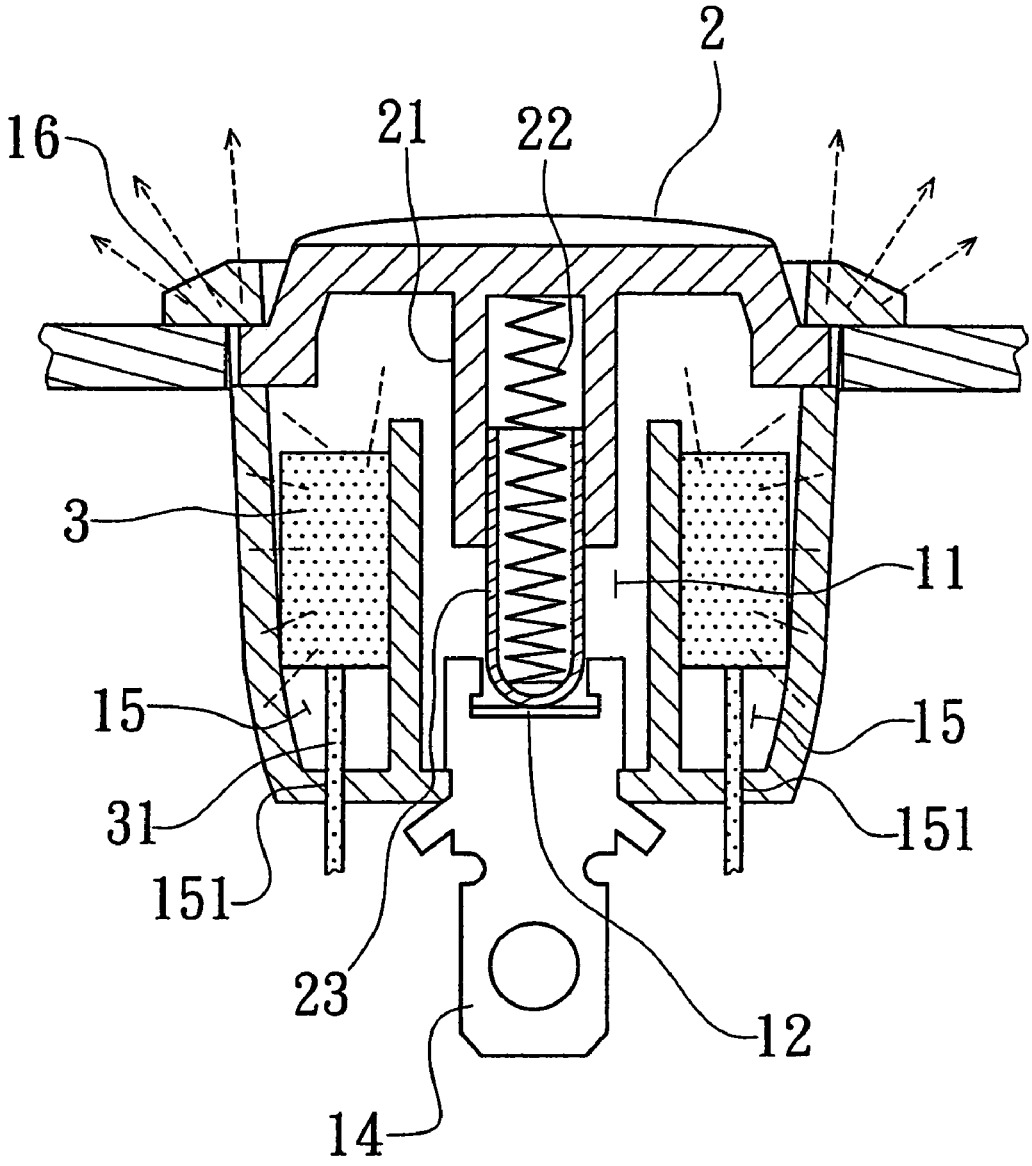
FIG. 2 is a cross-sectional view of the switch of the present invention.

Referring to FIGS. 1 and 2, a preferred embodiment of a switch includes a housing 1, a control member 2, and light emitting elements 3.

The housing 1 is transparent, and it has an opening at a first end, a holding room 11 therein, two holding spaces 15 on two sides of the holding room 11, an annular protrusion 16 around an outer side of the first end, terminals 13 and 14 passed through and secured to a second end thereof, and a pivotal conducting plate 12 in the holding room 11 thereof. In addition, holes 151 are formed on the second end of the housing 1.

The control member 2 has a pressed main portion, and a tube portion 21 projecting into the housing 1 from the main portion thereof. An elastic element 22 is held in the tube portion of the control member 2, and a conducting stick 23 is movably fitted to the tube portion 21, and biased away from the main portion of the control member 2 by the elastic element 22. The control member 2 is pivoted to the housing 1 with the main portion thereof being within the opening of the housing 1, and with the conducting stick 23 touching the conducting plate 12. The conducting plate 12 will touch both the terminals 13 and 14 as soon as the control member 2 is angularly displaced to an "on" position. And, the conducting plate 12 will separate from the terminal 13 as soon as the control member 2 is angularly displaced to an "off" position.

The light emitting elements 3, which can be light emitting diodes, are held in the holding spaces 15 of the housing 1 with legs 31 thereof projecting outwards through the holes 151 of the housing 1.

Figure 3:
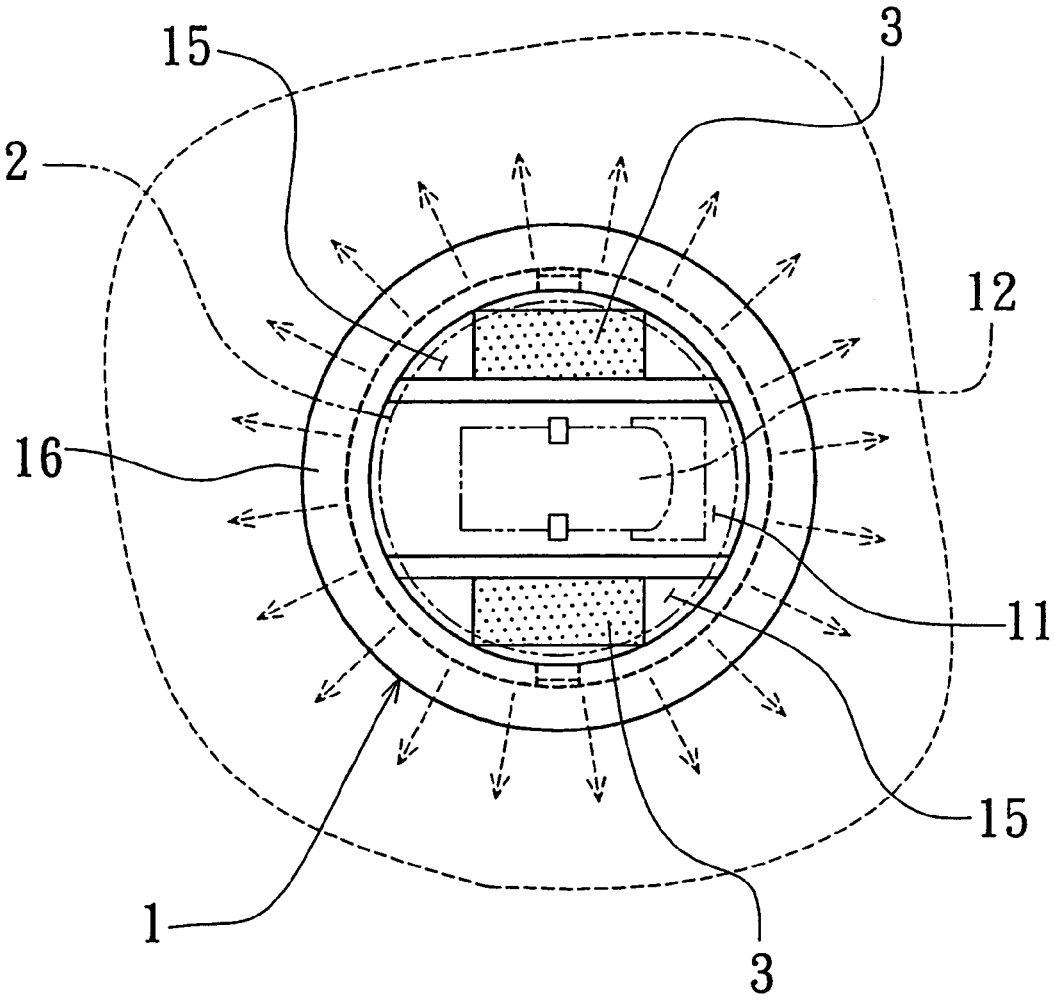
FIG. 3 is a view of the switch of the present invention in use.
Figure 4:
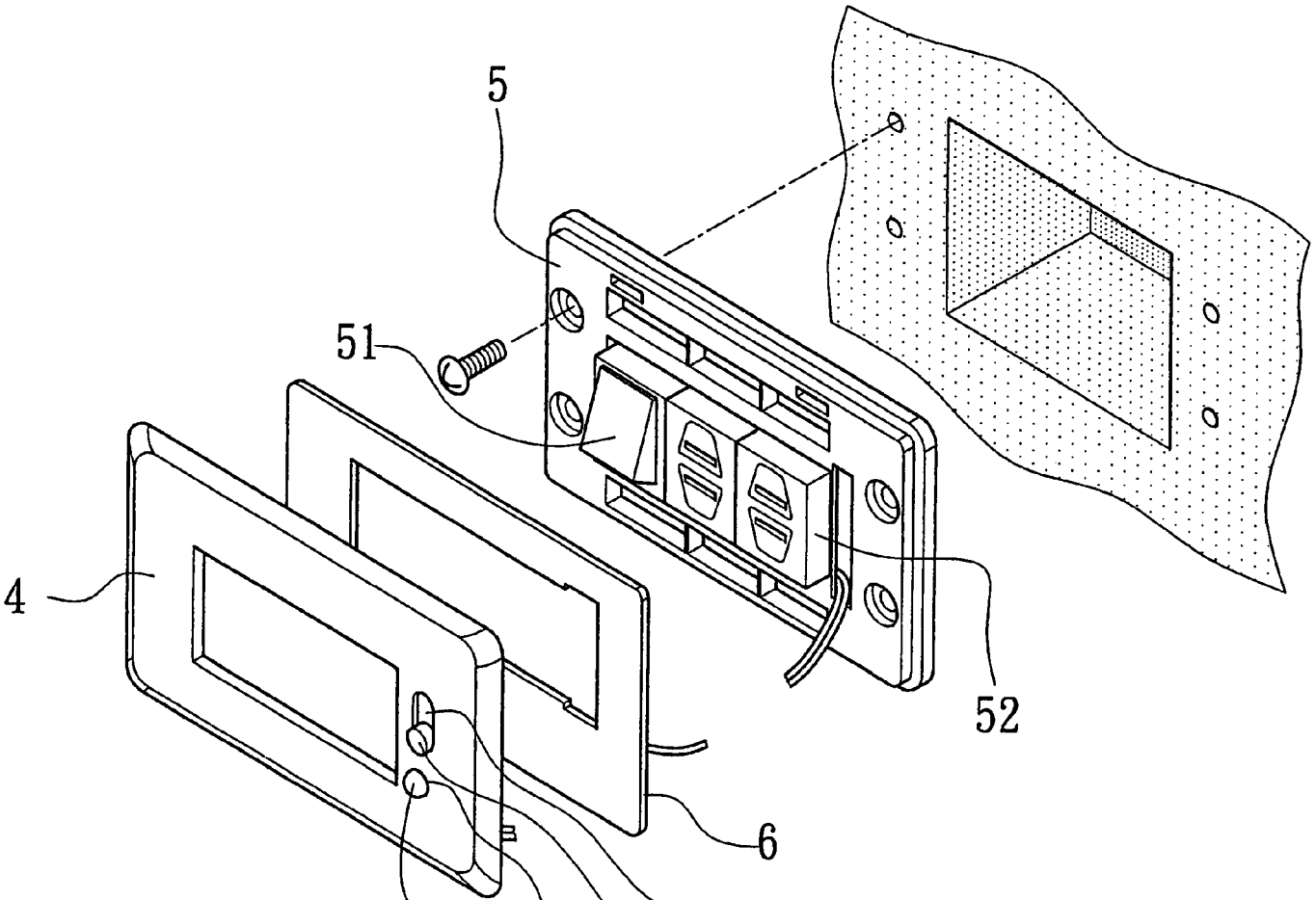
FIG. 4 (PRIOR ART)
FIG. 4 is an exploded perspective view of the conventional switch.

Thus, when the light emitting elements 3 are powered, a circle of light will show on the annular protrusion 16 of the housing 1, which is around the control member 2, as shown in FIG. 3.

The present switch is fitted on a socket with the terminals 13, 14 and the legs 31 of the light emitting elements 3 being connected to wires in the socket.

From the above description, it can be easily understood that the switch of the present invention has the following advantages:

1. The switch is available with the housing, the control member, and the light emitting elements already connected together. Therefore, to install the switch, one only has to connect the terminals 13, 14 and the legs 31 to wires in a socket. In other words, the switch is easy and takes little time to install.

2. When the light emitting elements are powered, a circle of light will show on the annular protrusion of the transparent housing, which is around the control member, allowing people to rapidly find the switch in the dark.

What is claimed is:

1. A switch capable of showing a circle of light thereon, comprising a transparent housing having an opening at a first end, and first and second terminals passed through a second end; the housing having a holding room therein, and two holding spaces on two sides of the holding room; the housing having an annular protrusion around an outer side of the first end; the housing having a plurality of holes on the second end thereof; the housing having a conducting plate in the holding room thereof, which plate is angularly displaced to a first position to touch both the first and the second terminals, and which is angularly displaced to such a position as to separate from one of the terminals;

a control member held in the housing, and pivoted to the first end of the housing for angularly displacing the conducting plate with; the control member having a pressed main portion held within the opening of the housing, and a tube portion projecting into the housing; the control member having an elastic element held in the tube portion; the control member having a conducting stick movably fitted to the tube portion and connected to the elastic element for constantly touching the conducting plate; and a plurality of light emitting elements held in the holding spaces of the housing; the light emitting elements having legs projecting outwards through the holes of the housing;

whereby a circle of light will show on the annular protrusion of the transparent housing around the control member when the light emitting elements are powered.

* * * * *